US008092966B2

(12) United States Patent
Kim et al.

(10) Patent No.: US 8,092,966 B2
(45) Date of Patent: Jan. 10, 2012

(54) TONER PARTICLE HAVING EXCELLENT CHARGING CHARACTERISTICS, LONG TERM CREDIBILITY AND TRANSFERRING PROPERTY, METHOD FOR PRODUCING THE SAME AND TONER CONTAINING SAID TONER PARTICLE

(75) Inventors: Jong-Eun Kim, Daejeon (KR); Hyeung-Jin Lee, Daejeon (KR); Bong-Hyun Jeong, Icheon (KR); Chang-Soon Lee, Daejeon (KR)

(73) Assignee: LG Chem, Ltd., Seoul (KR)

( * ) Notice: Subject to any disclaimer, the term of this patent is extended or adjusted under 35 U.S.C. 154(b) by 152 days.

(21) Appl. No.: 12/226,871

(22) PCT Filed: Nov. 14, 2007

(86) PCT No.: PCT/KR2007/005709

§ 371 (c)(1),
(2), (4) Date: Oct. 30, 2008

(87) PCT Pub. No.: WO2008/060095

PCT Pub. Date: May 22, 2008

(65) Prior Publication Data

US 2010/0151373 A1 Jun. 17, 2010

(30) Foreign Application Priority Data

Nov. 15, 2006 (KR) ..... 10-2006-0112918

(51) Int. Cl.
*G03G 9/087* (2006.01)

(52) U.S. Cl. ..... 430/109.1; 430/109.3; 430/109.4

(58) Field of Classification Search ..... 430/109.4, 430/109.1, 109.3
See application file for complete search history.

(56) References Cited

U.S. PATENT DOCUMENTS

| | | | | |
|---|---|---|---|---|
| 5,691,095 | A * | 11/1997 | Shinzo et al. | 430/108.21 |
| 6,096,467 | A | 8/2000 | Shimizu et al. | |
| 2002/0110746 | A1 * | 8/2002 | Oshiba et al. | 430/108.1 |

FOREIGN PATENT DOCUMENTS

| | | |
|---|---|---|
| JP | 63-184762 | 7/1988 |
| JP | 2-196246 | 8/1990 |
| JP | 9-274336 | 10/1997 |
| JP | 11-084717 | 3/1999 |
| JP | 05-107799 | 4/1999 |
| JP | 2001-013726 | 1/2001 |
| KR | 10-2004-0076647 A | 9/2004 |
| KR | 10-2006-0097978 | 9/2006 |

* cited by examiner

*Primary Examiner* — Hoa Le
(74) *Attorney, Agent, or Firm* — McKenna Long & Aldridge LLP

(57) ABSTRACT

The invention relates to toner particles having excellent charging characteristics and transferring properties, a method for producing the same and toner including the same. More particularly, the invention relates to toner particles, a method for producing the same and toner including the same, in which a CCA highly compatible with a binder resin is readily dispersed in the binder resin, thereby improving charge-maintaining property and charge distribution, and the resultant mixture is sphered to realize excellent long term credibility and transfer property. The toner particles include a styrene/acrylate-based CCA; a styrene/acrylate-based binder resin; and a polyester-based binder resin.

10 Claims, No Drawings

TONER PARTICLE HAVING EXCELLENT CHARGING CHARACTERISTICS, LONG TERM CREDIBILITY AND TRANSFERRING PROPERTY, METHOD FOR PRODUCING THE SAME AND TONER CONTAINING SAID TONER PARTICLE

This application is an application based on International Patent Application No. PCT/KR2007/005709 filed Nov. 14, 2007, which claims the benefit of Korean Application No. 10-2006-0112918 filed Nov. 15, 2006, which are hereby incorporated by reference for all purposes as if fully set forth herein.

TECHNICAL FIELD

The present invention relates to toner particles having excellent charging characteristics and transferring properties, a method for producing the same and toner including the same. More particularly, the invention relates to toner particles, a method for producing the same and toner including the same, in which a Charge Control Agent (CCA) highly compatible with a binder resin is readily dispersed in the binder resin, thereby improving charge-maintaining property and charge distribution, and the resultant mixture is sphered to realize excellent long term credibility and transfer property.

BACKGROUND ART

Demands for a copying machine and a laser printer are increasing more and more in response to wide distribution of Personal Computers (PCs) and office automation. Both the copying machine and the laser printer are an image forming apparatus that forms a desired image on a printing paper by transferring toner thereon, and thus essentially uses toner to form an image.

Along with the increasing demand of the market, consumer requirements for the copying machine, the laser printer and the like are gradually becoming stricter. Examples of such requirements include clearer image quality, durability ensuring that toner will show no deterioration in charging characteristics even if it has been used for a long time period, the miniaturization of the copying machine or the printer, low price, high printing speed, energy saving, easy recyclability and the like.

Of the above requirements, durability is required for toner itself. That is, durability ensures that a clear image can be continuously maintained and charging characteristics will not degrade. In the fields of producing toner, researches are being conducted in various aspects in order to produce durable toner.

Toner is a developer material that the printer or the copying machine, as mentioned above, uses to form an image on an image receptor in a transfer operation. In order to produce durable toner, which can continuously maintain a clear image, processes of using toner in the copying machine or the laser printer should be understood first of all.

An image forming apparatus, such as a copying machine or a laser printer, which produces printouts by transferring toner, generally carries out a printing process as follows:

1. First, a charging step of uniformly charging the surface of a drum is performed. The drum is generally implemented with an Organic Photo Conductor (OPC) drum and the like. The charging is conducted by electro-statically charging the surface of the drum using a charging rayon brush or the like.

2. An exposure step of forming a latent image by exposing the surface of the drum is followed. A conductor such as an OPC on the evenly-charged surface of the drum is an insulator when light is not incident thereon, but acts to conduct charges in the presence of light. Thus, when the drum surface is exposed to a beam for example from a laser, the portion exposed to the beam is discharged or neutralized.

3. Separately to the exposure step, a step of attracting toner to the surface of a developing roller is carried out. This step is a preliminary step, followed by a step of forming a toner image on the charged drum.

4. Then, the step of developing a toner image on the surface of the drum using toner, attracted to the surface of the developing roller, is performed. As mentioned above, when the drum surface is exposed to light, the exposed portion thereof is discharged or neutralized. This is because, when toner is charged with the same polarity as that of the drum, the surface of the drum, if not exposed to light, will repel toner, thereby preventing toner from migrating thereto. However, the exposed portion of the surface of the drum does not repel toner, so that toner can adhere to the latent image, thereby forming the toner image.

5. The developing step is followed by a step of transferring the toner image from the drum surface to an image-receiving paper (i.e., a printing paper). In the transferring step, the surface of the image-receiving paper is charged with a polarity opposite to that of toner in order to generate an attraction force for toner, and the drum and the image-receiving paper are placed adjacent to each other in order to facilitate the transferring.

6. Since toner is not permanently bonded to the image-receiving paper even though it is transferred to the image-receiving paper, a step of fusing toner to the image-receiving paper is followed. The fusing step is completed generally by allowing the image-receiving paper, on which the toner image is formed, to pass through a pair of rollers including a heat roller and a pressure roller, so that toner is compressed by heat and pressure and a binder contained in toner forms a coating layer around toner.

7. Finally, a step of cleaning residual toner from the surface of the drum prior to the recharge of the drum, so that the drum can be charged again for the next operation.

In consideration of the above-mentioned printing process, basic characteristics of toner required for respective steps of the printing process can be understood.

First, it is necessary that toner have at least a predetermined charge amount, so that toner can adhere to the developing roller, then be developed on the OPC drum, and then be transferred to the image-receiving paper. That is, since toner is charged by friction against a doctor blade in the process of adhering to the developing roller in a toner hopper of a toner cartridge, it is required that toner be charged with a predetermined amount or more, so that the subsequent steps, such as migration from the developing roller to the charged drum and transferring from the charged roller to the image-receiving paper, can be easily carried out.

It is also required that toner, after being charged, continuously maintain the charge state before being transferred to the image-receiving paper. This is referred to as charge-maintaining ability that can prevent the charge from being lost through contact with a conductive material or another toner and also ensure that toner maintain high chargeability.

There are also required some properties such as excellent transfer property, low temperature fusion ability and anti-offset property. With the excellent transfer property, toner can be easily transferred from the photoconductive drum to the image-receiving paper. The low temperature fusion ability allows toner to be easily fused even if it is not heated to a high temperature in the fusion. The anti-offset property can excellently resist against the offsetting of residual toner to the surface of the charged roller. In particular, the transfer property is greatly dependent upon the sphericity of toner, and thus, when the shape of the particles is irregular, a scattered laser beam may degrade the transfer property. That is, when color correction is carried out in the printer, the image density of an OPC drum is measured, followed by toner correction according to colors to be most similar to an actual image. If toner is completely spherical, color correction is made completely when the image density is measured. However, as the shape of toner deviates more from the spherical shape, the scattering of the laser beam will more degrade the correction, and thus a clear image cannot be produced. Furthermore, when the sphericity increases, the adhering force of toner is also enhanced to increase the migration of toner from the drum to a transfer belt, thereby improving the transfer property.

In addition, other properties such as cleaning performance and anti-contamination property are required.

In particular, recently, the above-mentioned properties are required complexly and comprehensively owing to the increased necessity of high image quality, high speed and color expression.

Accordingly, in order to satisfy all of the above requirements, a toner generally includes toner particles, which include a colorant, a binder resin, a wax, a dispersant, a charge control agent and the like, and an outer additive adhering to the outside surface of the toner particles.

The binder resin is melted by heating during the fusion of the toner to help the toner adhere to the surface of an image-receiving paper. The wax makes an image glossy after being printed while dropping the melting point of the toner particles. The dispersant induces uniform dispersion, and the charge control agent is used to control the charge of the surface of the toner particles.

Of these additives, because of the charge control agent (abbreviated "CCA") of the toner particles, the surface of the toner particles can be charged when the toner is in friction with a doctor blade. It is required that the CCA be dispersed as evenly as possible on the surface of the toner particles.

The CCA generally tends to form a phase separated from the binder resin. In this case, the toner in friction with the doctor blade is not evenly charged, and charge distribution is made very wide due to uneven fiction. Accordingly, respective toner particles have different charges, and thus are not suitably used in a printing, which is performed based upon the adjustment of the charge, Separately from the above, the toner particles are generally produced by a pulverization process of melting the above-mentioned components, forming a sheet material from the melt, and mechanically pulverizing the sheet material, or by a polymerizing process. The former process of mechanical pulverization is widely used up to present since it is relatively easier to produce toner. However, in the case of producing the toner particles by the mechanical pulverization, the toner particles come to have irregular shapes and a large amount of cracks exist in the surface of the toner particles. The problem of this process is that the radiation of light such as a laser beam causes very severe scattering. Accordingly, for the toner particles produced by the mechanical pulverization, it is required to overcome a problem of reduced transfer property.

As the printing speed of the printer changes among low, middle and high speeds, the charging characteristics of toner also change. When toner is charged without the consideration of the charging characteristics, an excessive charge may cause a background contamination such as tire tracking or an insufficient charge may produce an uneven image. Accordingly, it is required to provide toner products, which have a specific charge suitable for a respective printing speed. However, such toner products have not been developed up to the present.

DISCLOSURE OF INVENTION

Technical Problem

The present invention has been made to solve the foregoing problems with the prior art, and therefore an aspect of the present invention is to provide toner particles, in which a CCA is uniformed dispersed in a binder resin without forming a separate phase to ensure uniform chargeability across the whole toner particles, thereby providing a narrow charge distribution, excellent charge-maintaining ability, and thus excellent long term credibility, a method for producing the toner particles, and toner including the toner particles.

Another aspect of the invention is to provide toner particles having high transfer property, a method for producing the toner particles, and toner including the toner particles.

A further aspect of the invention is to provide toner particles, which can be suitably used in a low speed printing, a method for producing the toner particles, and toner including the toner particles.

Technical Solution

According to an aspect of the invention for realizing the object, the invention provides toner particles, which include a styrene/acrylate-based charge control agent (CCA); a styrene/acrylate-based binder resin; and a polyester-based binder resin.

The styrene/acrylate-based CCA may be styrene/n-butylacrylate (BA) or styrene/2-ethylhexylacrylate (EHA).

The CCA may have an amount ranging 0.2 to 2.0 percent by weight of the toner particles.

The styrene/acrylate-based binder resin may have an aid value ranging from 2 to 10 mgKOH/g and a weight-average molecular weight ranging from 100,000 to 230,000

The styrene/acrylate-based binder resin may have an amount ranging 40 to 60 percent by weight of the toner particles.

The polyester-based binder resin may have an aid value ranging from 8 to 12 mgKOH/g and a weight-average molecular weight ranging from 20,000 to 50,000.

The polyester-based binder resin may have an amount ranging from 30 to 50 percent by weight of the toner particles.

The toner particles may be sphered.

In particular, the toner sphering includes a mechanical process and a thermal process. The mechanical process generally produces spherical particles by colliding the toner particles against each other using a shearing force. The thermal process spheres the toner particles by heating them. The toner particles are more desirably sphered by the mechanical process since the mechanical process, compared to the thermal process, can further limit the particle size distribution of the toner particles and also minimize changes in physical properties.

Here, the toner particles may be mechanically sphered by colliding the toner particles against each other at a linear speed ranging from 75 to 100 m/s for 5 to 20 mins, so that the toner particles are ground.

The toner particles may further include toner particle additives such as a colorant, a dispersing agent, a wax, a flow promoter and a releasing agent.

According to another aspect of the invention for realizing the object, the invention provides a method for producing toner particles, which includes steps of: preparing a sheet material by kneading a mixture, which includes a 0.2 to 2.0 percent by weight styrene/acrylate-based CCA, a 40 to 60 percent by weight styrene/acrylate-based binder resin and 30 to 50 percent by weight a polyester-based binder resin; preparing toner particles by mechanically pulverizing the sheet material; and sphering the pulverized toner particles.

The styrene/acrylate-based CCA may be styrene/BA or styrene/2-EHA.

The styrene/acrylate-based binder resin may have an aid value ranging from 2 to 10 mgKOH/g and a weight-average molecular weight ranging from 100,000 to 200,000.

The polyester-based binder resin may have an acid value ranging from 8 to 12 mgKOH/g and a weight-average molecular weight ranging from 20,000 to 50,000.

The method may further include a step of: coating at least one selected from the group consisting of an organic particulate matter, silica and an inorganic particulate matter.

According to a further aspect of the invention for realizing the object, the invention provides toner, which includes toner particles, including a 0.2 to 2.0 percent by weight styrene/acrylate-based CCA, a 40 to 60 percent by weight styrene/acrylate-based binder resin and a 30 to 50 percent by weight polyester-based binder resin; and an outer additive coated on the toner particles.

The outer additive may be at least one selected from the group consisting of an organic particulate matter, silica and an inorganic particulate matter.

The styrene/acrylate-based CCA may be styrene/n-BA or styrene/2-EHA

The styrene/acrylate-based binder resin may have an acid value ranging from 2 to 10 mgKOH/g and a weight-average molecular weight ranging from 100,000 to 200,000.

The polyester-based binder resin may have an aid value ranging from 8 to 12 mgKOH/g and a weight-average molecular weight ranging from 20,000 to 50,000.

Here, the toner particles may be sphered.

BEST MODE FOR CARRYING OUT THE INVENTION

Hereinafter the present invention will be described more fully.

The present inventors have studied to obtain desirable toner particles, which have a wide charge distribution and excellent charge-maintaining ability. As a result, the present inventors found that a CCA of the toner particles can be evenly dispersed in a binder resin of the toner particles, when they are highly compatible, thereby overcoming the problems with the prior art such as uneven charging characteristics, and the present invention has been achieved based on this finding.

That is, the toner particles of the invention include a binder, a CCA, a colorant, a dispersant, a wax, a flow promoting agent, a releasing agent and other additives. Of these additives, the contents of the binder and the CCA are controlled to a specific range.

In the toner particles of the invention, the CCA is implemented as a styrene/acrylate-based resin such as styrene/n-butylacrylate (BA) or styrene/2-ethylhexylacrylate (2-EHA), and the binder is implemented as styrene/acrylate and polyester.

The styrene/acrylate-based CCA is highly dispersive because of excellent compatibility between the CCA and styrene/acrylate of the binder. The styrene/acrylate-based CCA, when used, can provide uniform charging characteristics and also improve charging efficiency. If the whole quantity of the binder is styrene/acrylate, the affinity between the CCA and the binder is excessively high, so that a homogeneous state is obtained. However, in order to obtain good charging characteristics and transferring property, the binder may be separated in phase, forming very small particles, rather than being completely mixed. That is, in order to obtain optimum image uniformity and transferring property, microphase separation is required, and macrophase separation is not desirable. In the case of macrophase separation, uneven charging characteristics may degrade developing characteristics (e.g., degrade transfer property or long term credibility), and completely uniform phases are not desirable since poor charging characteristics may degrade developing characteristics (e.g., decrease image density or seriously degrade transfer property). Accordingly, it should be appreciated that the term "good dispersion" indicates microphase separation, in which microphases are evenly dispersed.

In the case of mechanically pulverizing a raw material sheet to produce toner particles, it is required that cracks be formed in and propagate through the sheet, so that the sheet can be pulverized into the toner particles. In this case, the cracks generally propagate through the phase separation interface of two phases. However, in the case where the CCA is implemented as a styrene/acrylate-based resin and the binder is implemented as only styrene/acrylate, the CCA and the binder are evenly mixed with each other, thereby preventing the phase separation interface from forming. Accordingly, it is required that the binder additionally contain, in addition to styrene/acrylate, a component for sufficiently forming separation interfaces.

According to the study of the inventors, the additional component may include polyester having a specific condition. Polyester contained in the binder can sufficiently provide phase separation interfaces (micro-interfaces), and facilitates the binder to mix with a styrene/acrylate resin by molecular weight control. Accordingly, it is suitable that polyester be contained in the binder resin.

The CCA of the toner particles may be implemented as a styrene/acrylate-based resin as mentioned above, such as styrene/BA or styrene/2-EHA. Of these components, a component having a relatively small molecular weight may be usably used in order to improve the compatibility with the binder resin. For example, the usable component may have a weight-average molecular weight in the range from 2,000 to 15,000. Typically, the CCA shows optimum characteristics when its content is in the range from 2 to 5 percent by weight of the toner particles. According to the invention, in the case where the CCA is used together with the above-mentioned type of binder resin, the content of the CCA may be in the range from 0.2 to 2.0 percent by weight, and more particularly, from 0.5 to 1.5 percent by weight of the toner particles.

The CCA can provide sufficient effects even if its content is smaller than typical values because the CCA evenly dispersed in the binder resin can improve charging characteristics such as charge distribution and charge-maintaining ability. When the content of the CCA is excessive, tire tracking, which is a type of background contamination, occurs, thereby severely soiling an image. When the content is below 0.2%, the toner is not evenly charged, possibly forming an uneven image. In particular, a low speed printer would easily have a high charge state since its frictional force between the developer roller and the doctor blade is larger than that of a middle or high speed printer. When the CCA content is above 2.0 percent by weight, the high charge state would be intensified, so that the tire tracking muffs. The tire tracking is a phenomenon caused by an increase in the overall charge of toner in the duration of toner printing or an increase in the charge between toner particles. This causes contamination on the background of the paper (or background contamination) like a tire tracking, which is left on the road when a car suddenly stops.

Furthermore, in the binder resin of the invention, styrene/acrylate may have an acid value ranging from 2 to 10 mgKOH/g and a weight-average molecular weight ranging from 100,000 to 200,000 Polyester may have an aid value ranging from 8 to 12 mgKOH/g and a weight-average molecular weight ranging from 20,000 to 50,000.

The acid value of the styrene/acrylate-based resin below 2 mgKOH/g may drop transfer property. On the contrary, when the acid value is above 10 mgKOH/g, the background is more contaminated. When the weight-average molecular weight of the styrene/acrylate-based resin is below 100,000, there are observed a blocking, in which toner is fused to the doctor blade, or a hot offset, in which toner is fused to the heat roller. On the contrary, when the weight-average molecular weight is above 200,000, a cold offset and a resultant jam take place. Similarities are observed in a polyester resin. That is, an acid value below a predetermined range degrades transfer property, and an excessively high add value leads to a background contamination. When the average-weight molecular weight of the polyester resin is below a predetermined range, a hot offset eclairs, but when the average-weight molecular weight of the polyester resin is above the predetermined range, poor dispersion degrades the long term charge credibility of toner.

In particular, as seen in the above, polyester in the binder resin of the toner particles of the invention has a considerably small average-weight molecular weight in comparison to that of styrene/acrylate in the binder resin. This is because to help the polyester-based binder resin permeate into pores of the styrene/acrylate-based binder resin, so that the two binder resins easily mix. Accordingly, even if a relatively large amount of polyester-based binder resin is mixed with a styrene/acrylate-based binder resin, a heterogeneous phase is not formed.

As a result, in the toner particles of the invention, the content of the styrene/acrylate-based binder resin may be in the range from 40 to 60 percent by weight, and desirably, from 45 to 55 percent by weight. The content of the polyester-based binder resin may be in the range from 30 to 50 percent by weight. When the content of the polyester-based binder resin is too small, transfer property and long term credibility become poor. On the contrary, when the content of the polyester-based binder resin is too large, macrophase separation occurs between the polyester-based binder resin and the styrene/acrylate-based resin, thereby forming uneven toner particles. Of course, it is not desirable. When the content of the styrene/acrylate-based binder resin is excessively large, the content of the polyester-based resin becomes excessively small. Thus, the content of the styrene/acrylate-based resin are given upper and lower limits in the same reason as the polyester resin is given upper and lower limits. It is most preferable, however, the content of the styrene/acrylate-based binder resin be in the range from 45 to 55 percent by weight, so that the toner particle can have long term credibility in charging characteristics and transfer property.

In addition to the binder resin and the CCA having the above-mentioned content range, other additives such as a colorant, a wax, a flow promoter and a releasing agent can be further added to the toner particles. That is, the essential concept of the invention is to use the CCA and the binder resin having the above-mentioned conditions as components of toner, and any types of additives can be included in the toner particles as long as they do not depart the concept of the invention.

Furthermore, the toner particles of the invention are mechanically pulverized and thus have very uneven shapes. When toner is produced from unevenly-shaped toner particles, laser beam scattering makes it impossible to obtain correct images and also reduces charge stability, thereby degrading transfer property and long term credibility.

Accordingly, it is preferable that sphering be performed after the mechanical pulverization, so that the toner particles have a spherical shape. Preferably, the sphering is mechanically carried out by colliding the toner particles against each other at a linear speed of 75 to 100 m/s for 5 to 20 mins, so that the toner particles are ground. When the time and the speed of the sphering are below the specified ranges, sphericity is not enough, and long term credibility and transfer property become unsatisfactory. Accordingly, the purpose of the sphering cannot be realized. On the contrary, the time and the speed exceeding the specified ranges are not desirable either since a further improvement in property is rarely expected. Accordingly, it can be a loss in terms of time and energy (yield).

Hereinafter a method for producing toner particles will be described in brief.

First, a sheet material is prepared by mixing and kneading raw materials of the toner particles according to the above-mentioned binder content and CCA content.

Next, the sheet material is mechanically pulverized into the toner particles.

A step of sphering the pulverized toner particles is followed, detailed conditions of which have been described earlier herein.

Through the above process, it is possible to produce desired toner particles, which have a narrow charge distribution, excellent charge-maintaining property, excellent long term credibility and good transfer property.

Optionally, a step of coating a suitable outer additive on the surface of the toner particles may be followed. Available examples of the outer additive may include an organic particulate matter, an inorganic particulate matter and/or silica. Any of external additives, which are used in the production of typical types of toner, can be coated on the surface of the toner particles of the invention.

Through the above-mentioned process, it is possible to produce printer toner, which has the outer additives coated on the surface of toner particles.

The invention will now be described with reference to Examples. It should be understood, however, the following Examples be provided by way of example but do not limit the scope of the present invention. Rather, the scope of the present invention shall be defined by the appended claims and equivalents thereof.

MODE FOR THE INVENTION

Manufacture of Toner

Non-magnetic toner particles having a particle size in the range from 7.5 to 8 μm were produced by mixing raw materials having compositions as described in Table 1 below using a Hansel mixer, melting and kneading the mixture at 150° C. in a biaxial melting kneader, drawing the mixture into a sheet, cooling the sheet, crushing the sheet at a particle size of several micrometers using a Hammer mixer, followed by fine pulverizing, and then classification using a classifier.

Sphering indicated in Table 1 below was mechanically carried out by colliding obtained toner particles against each other at a linear speed of 75 to 100 m/s for 5 to 20 mins, so that the toner particles were ground against each other.

A styrene/acrylate-based CCA, which had a weight-average molecular weight in the range from 2,000 to 15,000 and an acid value in the range from 15 to 25 mgKOH/g, was used. In all Examples and Comparative Examples, a pigment and a wax were added in a total amount of 7 percent by weight in order to avoid any influence due to the variation of the amount of the wax and the pigment.

A mono-component system color toner was produced by stirring and mixing poly-methylmethacrylate (PMMA) having an average particle size of 0.1 to 1 μm with an amount of 0.5 percent by weight and silica having an average particle size of 12 nm with an amount of 3 percent by weight, and coating the mixture on sphered or unsphered toner particles of 100 percent by weight.

TABLE 1

| No. | Styrene/Acrylate resin | Polyester resin | CCA | Sphering |
|---|---|---|---|---|
| Exam 1 | 47.2 | 45 | 0.8 | Yes |
| Exam 2 | 40 | 52.8 | 0.2 | Yes |
| Exam 3 | 40 | 52.5 | 0.5 | Yes |
| Exam 4 | 40 | 52 | 1.0 | Yes |
| Exam 5 | 40 | 51 | 2.0 | Yes |
| Exam 6 | 50 | 42.8 | 0.2 | Yes |
| Exam 7 | 50 | 42.5 | 0.5 | Yes |
| Exam 8 | 50 | 42 | 1.0 | Yes |
| Exam 9 | 50 | 41 | 2.0 | Yes |
| Exam 10 | 60 | 32.8 | 0.2 | Yes |
| Exam 11 | 60 | 32.5 | 0.5 | Yes |
| Exam 12 | 60 | 32 | 1.0 | Yes |
| Exam 13 | 60 | 31 | 2.0 | Yes |
| Comp Exam 1 | 92.9 | — | 0.1 | Yes |
| Comp Exam 2 | 92.9 | — | 0.5 | Yes |
| Comp Exam 3 | 92.0 | — | 1.0 | No |
| Comp Exam 4 | 92.0 | — | 1.0 | Yes |
| Comp Exam 5 | 89.0 | — | 4.0 | Yes |
| Comp Exam 6 | 80 | 12.9 | 0.1 | Yes |
| Comp Exam 7 | 80 | 12.5 | 0.5 | Yes |
| Comp Exam 8 | 80 | 12.0 | 1.0 | No |
| Comp Exam 9 | 80 | 12.0 | 1.0 | Yes |
| Comp Exam 10 | 80 | 9.0 | 4.0 | Yes |
| Comp Exam 11 | 70 | 22.9 | 0.1 | Yes |
| Comp Exam 12 | 70 | 22.5 | 0.5 | Yes |
| Comp Exam 13 | 70 | 22.0 | 1.0 | No |
| Comp Exam 14 | 70 | 22.0 | 1.0 | Yes |
| Comp Exam 15 | 70 | 19.0 | 4.0 | Yes |
| Comp Exam 16 | 30 | 62.9 | 0.1 | Yes |
| Comp Exam 17 | 30 | 62.5 | 0.5 | Yes |
| Comp Exam 18 | 30 | 62.0 | 1.0 | No |
| Comp Exam 19 | 30 | 62.0 | 1.0 | Yes |
| Comp Exam 20 | 30 | 59.0 | 4.0 | Yes |
| Comp Exam 21 | 10 | 82.9 | 0.1 | Yes |
| Comp Exam 22 | 10 | 82.5 | 0.5 | Yes |
| Comp Exam 23 | 10 | 82.0 | 1.0 | No |
| Comp Exam 24 | 10 | 82.0 | 1.0 | Yes |
| Comp Exam 25 | 10 | 79.0 | 4.0 | Yes |

In Table 1 above, the content of each component is represented by weight percent of toner particles.

Printouts up to 3,000 sheets were made from non-magnetic, mono-component system color toners, produced in Examples 1 to 13 and Comparative Examples 1 to 25, at a room temperature and humidity environment (20 C, 55% RH) using a non-magnetic, mono-component developing printer (HP2500 available from Hewlett-Packard). Transferring property, long term property and tire tracking were measured according to the following conditions, and the results are reported in Table 2 below.

1) Transfer property: The percentage of toner, purely transferred to the sheets, was measured for the 3,000 printouts, on the basis of every 500 sheets, by calculating net consumption amount by subtracting loss from consumption amount.

A: Transfer property 75% or more

B: Transfer property 65~75%

C: Transfer property 55~65%

D: Transfer property 55% or less

2) Long term property: Degrees of consumption amount and transfer property, maintained with respect to initial values, were measured by printing up to 3,000 sheets.

A: Consumption amount and transfer property, maintained 90% or more

B: Consumption amount and transfer property, maintained 80 to 90%

C: Consumption amount and transfer property, maintained 70 to 80%

D: Consumption amount and transfer property, maintained 70% or less

3) Tire Tracking: Examination was made on tire tracking or one type of background contamination, in which a toner layer on the sleeve becomes thick and leaves a strip shape similar to a spotty pattern, which contaminates an image.

X: No tire tracking formed

O: Tire tracking formed

TABLE 2

| No. | Transfer property | Long term property | Tire tracking |
|---|---|---|---|
| Exam 1 | A | A | X |
| Exam 2 | B | B | X |
| Exam 3 | A | B | X |
| Exam 4 | A | B | X |
| Exam 5 | A | B | X |
| Exam 6 | B | B | X |
| Exam 7 | A | A | X |
| Exam 8 | A | A | X |
| Exam 9 | A | B | X |
| Exam 10 | B | B | X |
| Exam 11 | A | A | X |
| Exam 12 | A | A | X |
| Exam 13 | B | B | X |
| Comp Exam 1 | D | D | X |
| Comp Exam 2 | C | C | X |
| Comp Exam 3 | D | D | X |
| Comp Exam 4 | C | C | X |
| Comp Exam 5 | C | D | ○ |
| Comp Exam 6 | D | D | X |
| Comp Exam 7 | C | C | X |
| Comp Exam 8 | D | D | X |
| Comp Exam 9 | C | C | X |
| Comp Exam 10 | C | D | ○ |
| Comp Exam 11 | D | D | X |
| Comp Exam 12 | B | B | X |
| Comp Exam 13 | D | D | X |
| Comp Exam 14 | B | B | X |
| Comp Exam 15 | C | D | ○ |
| Comp Exam 16 | D | D | X |
| Comp Exam 17 | C | C | X |
| Comp Exam 18 | C | D | X |
| Comp Exam 19 | D | D | X |
| Comp Exam 20 | D | D | ○ |
| Comp Exam 21 | D | D | X |
| Comp Exam 22 | D | D | X |
| Comp Exam 23 | D | D | X |
| Comp Exam 24 | D | D | X |
| Comp Exam 25 | D | D | ○ |

As reported Table 2 above, Examples 1 to 13 using the binder and the composition range of the invention show good results, with transfer property and long term property being A or B grade. However, Comparative Examples out of the composition range of the invention generally show C or D grade. Furthermore, in the case of Comparative Examples 5, 10, 15, 20 and 25, a background contamination of tire tracking was observed.

Accordingly, the superiority of toner particles, a method of producing the toner particles and toner including the toner particles of the invention was observed.

INDUSTRIAL APPLICABILITY

According to the invention as set forth above, the compatibility between a binder resin and a CCA can be increased to help the CCA readily disperse in the binder resin, thereby improving the charge-maintaining property and charge distribution of toner particles. Furthermore, the invention can prevent tire tracking by sphering the toner particles.

The invention claimed is:

1. Toner particles, comprising:

0.2 to 2.0 wt % of a styrene/acrylate-based charge control agent which is styrene/n-butylacrylate or styrene/2-ethylhexylacrylate having a weight-average molecular weight ranging from 2,000 to 15,000;

40 to 60 wt % of a styrene/acrylate-based binder resin having an acid value ranging from 2 to 10 mgKOH/g and a weight-average molecular weight ranging from 100,000 to 200,000; and 30 to 50 wt % of a polyester-based binder resin having an acid value ranging from 8 to 12 mgKOH/g and a weight-average molecular weight ranging from 20,000 to 50,000, wherein the toner particles are sphered.

2. The toner particles of claim 1, wherein the toner particles are mechanically sphered by colliding the toner particles against each other at a linear speed ranging from 75 to 100 m/s for 5 to 20 mins, so that the toner particles are ground.

3. The toner particles of claim 1, further comprising toner particle additives including a colorant, a dispersing agent, and a flow promoter.

4. A method for producing toner particles, comprising: preparing a sheet material by kneading a mixture, which includes 0.2 to 2.0 percent by weight of a styrene/acrylate-based charge control agent, 40 to 60 percent by weight of a styrene/acrylate-based binder resin and 30 to 50 percent by weight of a polyester-based binder resin; preparing toner particles by mechanically pulverizing the sheet material; and sphering the pulverized toner particles.

5. The method of claim 4, wherein the styrene/acrylate-based charge control agent comprises styrene/n-butylacrylate or styrene/2-ethylhexylacrylate.

6. The method of claim 4, wherein the styrene/acrylate-based binder resin has an acid value ranging from 2 to 10 mgK0H/g and a weight-average molecular weight ranging from 100,000 to 200,000.

7. The method of claim 4, wherein the polyester-based binder resin has an acid value ranging from 8 to 12 mgK0H/g and a weight-average molecular weight ranging from 20,000 to 50,000.

8. The method of claim 4, further comprising: coating at least one selected from the group consisting of an organic particulate matter, silica and an inorganic particulate matter.

9. A toner comprising:

toner particles of claim 1, which include 0.2 to 2.0 percent by weight of a styrene/acrylate-based charge control agent which is styrene/n-butylacrylate or styrene/2-ethylhexylacrylate having a weight-average molecular weight ranging from 2,000 to 15,000, 40 to 60 percent by weight of a styrene/acrylate-based binder resin having an acid value ranging from 2 to 10 mgKOH/g and a weight-average molecular weight ranging from 100,000 to 200,000 and 30 to 50 percent by weight of a polyester-based binder resin having an acid value ranging from 8 to 12 mgKOH/g and a weight-average molecular weight ranging from 20,000 to 50,000, wherein the toner particles are sphered; and an outer additive coated on the toner particles.

10. The toner of claim 9, wherein the outer additive comprises at least one selected from the group consisting of an organic particulate matter, silica and an inorganic particulate matter.

* * * * *